United States Patent [19]

Keller

[11] 3,980,378

[45] Sept. 14, 1976

[54] CLIP CONNECTION

[75] Inventor: Roman Keller, Erlangen, Germany

[73] Assignee: Siemens Aktiengesellschaft, Munich, Germany

[22] Filed: June 9, 1975

[21] Appl. No.: 585,373

[30] Foreign Application Priority Data

June 24, 1976 Germany ..... 2430172

[52] U.S. Cl. ..... 339/95 R; 339/244 R

[51] Int. Cl.[2] ..... H01R 9/16

[58] Field of Search ..... 339/95 R, 95 D, 97 R, 339/97 P, 244 R, 244 UC

[56] References Cited

UNITED STATES PATENTS

| | | | |
|---|---|---|---|
| 3,239,918 | 3/1966 | Cobaugh | 339/97 R |
| 3,243,757 | 3/1966 | Cobaugh | 339/97 R |
| 3,251,022 | 5/1966 | Hammell | 339/97 R |

*Primary Examiner*—Roy Lake
*Assistant Examiner*—Paul A. Bell
*Attorney, Agent, or Firm*—Kenyon & Kenyon Reilly Carr & Chapin

[57] ABSTRACT

An improved sheet metal clip for sliding on a connector pin to make a Termi point connection in which the sheet metal ends are beveled to avoid chip formation when applying the clip to the connector pin providing improved electrical contact and permitting use of a connector pin having tin coat thickness for solder connections.

5 Claims, 7 Drawing Figures

CLIP CONNECTION

BACKGROUND OF THE INVENTION

This invention relates to electrical connections in general and more particularly to an improved metal clip for making an electrically conducting fastening of a bare wire to a connector pin.

Connector pins which comprise a piece of sheet metal bent in a U-section with the free legs of the U-section also bent in U-shapes at their end to fit as a sleeve over a connector pin holding a wire in place between the base of the U and the connector pin are known. Such clips are commercially available and are used, for example, for the external wiring of plug connectors.

However, other methods of attaching wires to connector pins are also known. For example, connections can be made as solder connections, wire-wrap connections, and Faston connections in addition to the Termi point connection which uses the aforementioned clip. Thus, from both a technical and economic view point it is advantageous if an external wiring connector pin, preferrably having a cross-sectional area of 1 mm × 1 mm can be used for all these various types of connections.

For such a pin to be used in making good solder connections the connector pins must be coated with a tin film which is at least 5 $\mu$m thick. However, with thicker coatings chip formation can occur when the metal clip is applied to make a Termi point connection. This can cause short circuits in the wiring panel. In order to avoid this danger connector pins used in Termi point clips are required to have a tin coat of 4 $\mu$m thickness with a maximum tolerance of $\pm$ 2 $\mu$m. Thus, a pin with a tin coating of between 5 and 6 $\mu$m thickness is usable for both solder and Termi point connections. However, such a narrow tolerance range is difficult and uneconomical to obtain in large scale mass production, if it can be obtained at all.

Thus, the need for an improved metal clip of the type described above which does not form chips and which can thus be used with a connector pin which is also suited for other connecting techniques becomes evident.

SUMMARY OF THE INVENTION

The present invention provides such a metal clip. The problem found in the prior art is solved by making the sheet metal ends of both legs with a bevel pointing toward the inside of the clip. The bevel starts from the one side, i.e., the side which is first inserted over the connector pin, and extends over a portion of their length. In particular, it is advantageous if the bevel be rounded and form a shape which corresponds to the runner of a sled or the like. With such a design of the leading edge of the legs of the clip the force required for application is reduced and chip removal is reliably prevented even if the tin coating on the connector pin is thicker than 4 $\mu$m $\pm$ 2 $\mu$m. Through this design the thickness of the connector pins tin coating may be greater than this amount and thus a single connector pin can be used for all four types of connections mentioned above, and in particular can also be used for soldering.

In accordance with the present invention, it is also advantageous if the ends of the clip which rest on a side surface of the connector pin are corrugated at least over a portion of their length. In particular a sequence of triangular cutouts results in advantages. In making such cutouts, it is beneficial if at least the leading edge of the first of the sequence of triangular cutouts has the shape of a runner. Which such an arrangement, the clip ends when bent in a U-shape do not rest on the connector pin with a line contact, but with point contact. The waves or points of the corrugated or triangular cutouts result in a point contact which penetrates the tin coating because of the high contact pressures which occur. Thus, an optimum electrical contact is obtained since any oxide surface films of reduced electrical conductivity are penetrated. With the triangular design in which the leading edges of the triangles are beveled chip formation from sliding the clip over the tin coating is avoided thereby permitting a gentler application of the connector pin. On the other hand, the forces required to pull the clip off the pin are increased considerably resulting in a high degree of a mechanical and electrical contact even under higher mechanical stresses. This in turn results in a safer connection. The requirements of very narrow limits of the thickness of the tin coating which are extremely difficult to maintain in mass production and yet absolutely required if the pin is to be used both in conventional clips without chip removal and for solder connections need no longer be maintained when using the clips according to the present invention.

DETAILED DESCRIPTION OF THE PREFERRED EMBODIMENT

Figure 2:
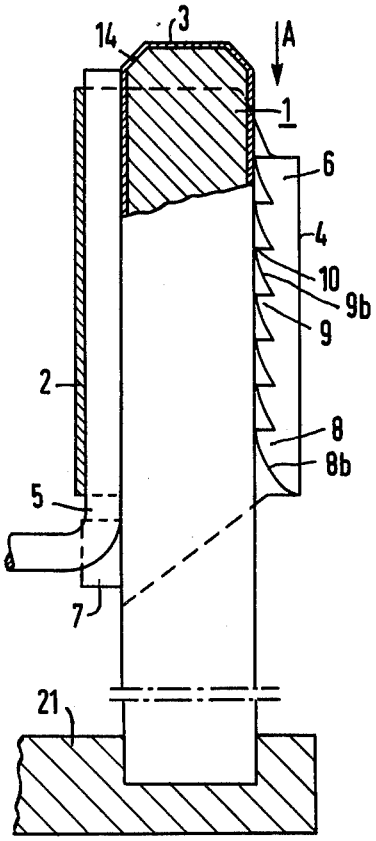
FIG. 2 is a longitudinal view, partially in cross-section of the arrangement of FIG. 1.
Figure 1:
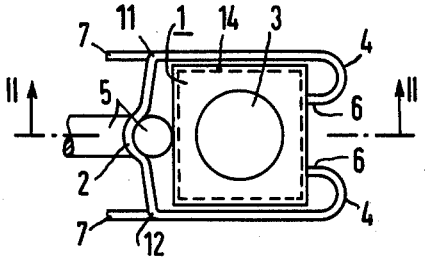
FIG. 1 is a end view of the clip of the present invention attached to a connector pin.

As illustrated by FIGS. 1 and 2, a connector pin 1 is provided having a conically tapered end terminating in a circular area 3. This tapering aids in inserting the pin onto a clip. In conventional fashion, the pin is surrounded on three sides by a connecting clip which also, with its side 2, holds a solid or stranded conductor, against one face of the pin 1. As illustrated, the stranded or solid wire 5 runs parallel to and is held in contact against one edge of the pin. The two free ends or legs of the clip have a U-shaped bend 4 so as to cause the end 6 of the legs to point inward and contact a face of the pin 1. These ends 6 rest on the fourth side of the connector pin, i.e., the side which is not fully enclosed by the clip and provide contact pressure for the electrical conductor 5.

Both with regard to its electrical and mechanical properties the clip material must meet strigent requirements. In order to provide good electrical contact it must be made of an electrically highly conductive material. Furthermore the clip material must be a high strength material in order to attain the required contact pressures and yet have a certain elasticity to insure a fatigueless contact between the connector pin and the electrical conductor. Furthermore, the hardness of the material must be greater than that of the tin film 14 which coats the connector pin. This is necessary so that the triangular points to be described below can penetrate the tin coating under the influence of the contact pressure. A material which meets these requirements and which is normally used for such clips is spring bronze, for example.

As indicated above and as shown on FIG. 2 the electrical conductor runs parallel to the longitudinal centerline of the contact pin 1 and is pressed against it by the clip 2 which was pushed over the connector pin 1 in the direction of the arrow A. The end of the conductor points towards the free end of the connector pin. The wire 5 is led out of the clip at the lower clip end facing the anchorage of the connector pin in a carrier material. Tabs 7 restrict lateral motion and bending of the wire.

On the side of the connector pin 1 opposite the wire 5 the ends 6 of the clip pointing toward the connector pin and resting against it due to being bent in a U-shape do not end in a straight line but in a sequence of triangular cutouts. The free points 10 of these triangular cutouts rests against the one side of the connector pin. The first tooth 8 located on the bottom and facing the anchorage of the connector pin in the body of the plug connector has the shape of a runner 8*b*. This first bevel is followed, with reference to FIG. 2, by a series of triangular cutout 9. The lower side of each triangular cutout 9 which is closest to the plug connector 21 is hereinafter referred to as the leading edge. The second, upper side of each triangular cutout will be designated as the rear edge. In the arrangement of FIG. 2, all leading edges of the triangular cutouts have a runner shape 9*b*. This permits the clip to glide over the tin film 14 when applied to the connector pin thereby avoiding any chip removal. The bare connecting wire 5 is clamped to the opposite side between the clip and connector pin 1.

Once applied to the pin, the points 10 of the triangular cutouts 9 dig into the tin film 14 because of the clip's contact pressure. Even when first sliding the clip on the outside, surface films of the tin coating which have poor electrical conductivity are penetrated or cut through. Thus an optimum electrical contact is obtained. The forces required for applying the clip are substantially reduced due to the design of the leading edges. However, forces required to pull the clip off are greatly increased because of the triangular points 10 which penetrate into the tin coating 14 and the extremely steep rear edges of the triangular cutouts 9 which act as barbs. This prevents the clip from becoming loose by itself due to vibration stresses. In order to detach such a clip the clip should not be pulled off the connector pin as this would require substantial force and would result in damage to the surface of the pin because of the triangular points which penetrate the tin. Instead the clip should be bent open laterally using a suitable tool.

However, the triangles can be designed instead in the form of waves or corrugations to reduce or eliminate the barb action. In such a case the clip can be pulled off the pin without injury to the surface and without undue force. A pin of this nature is illustrated by FIG. 4*d* which will be explained in more detail below.

As is evident from the discussion above the limitation of the tin coat thickness to a maximum of 6 $\mu$m with a narrow tolerance range is unnecessary when using the metal clip of the present invention. The design of the clip prevents chip removal. In fact, a thicker tin coating even offers advantages. Because of the possibility of a deeper penetration of the triangular points 10 into a thicker tin coating 14 there will be an improvement of electrical contact, increased safety against chip removal and equalization of the height difference of the individual triangular points.

Figure 3:
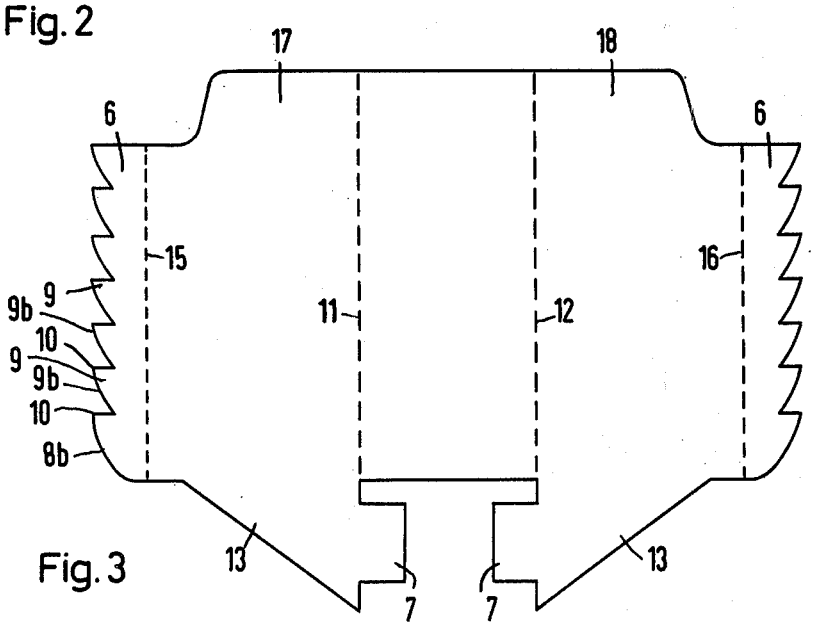
FIG. 3 is a plan view showing a development of the clip blank.

FIG. 3 illustrates a development of the clip 2 of FIGS. 1 and 2. This illustrates the basic clip blank which can be produced by stamping out of a spring bronze sheet. Furthermore it permits variations in the production process. The two sides of the basic clip blank ends which terminate in triangular cutouts 9 have been described above. i.e., The manner in which contact is made with the leading edges 8*b* and 9*b* to prevent chip removal has been described above. The rear edge of each of the triangular cutouts run essential at right angles to the bending lines 15 and 16 to result in a good barb effect leading to a claw action once the clip is applied to the connector pin. At the bottom the development of the clip blank ends in two projections 13 which are used as supports for the tabs 7. To manufacture the clip of the present invention previously used stamping dies need only be modified slightly in order to give the clip blank lateral ends a wavy rather than a straight form, i.e., previous clips were made from a similar blank the primary difference being in the clip ends 6 which in the prior art were simply straight edges. Once the chip blank has been made the lateral ends 6 must be bent in a U-shape approximately along the lines 15 and 16. Thereafter, another 90° bending operation along the bending lines 11 and 12 takes place to bring the surfaces 17 and 18 parallel to each other. This brings the tabs 7 into their final position in which they can restrain lateral deflection of the wire 5 of FIGS. 1 and 2.

Figure 4A:
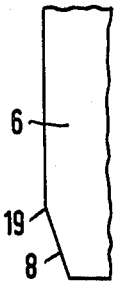
FIGs. 4*a*, 4*b*, 4*c* and 4*d* illustrate four different clip end designs in accordance with the present invention.
Figure 4B:
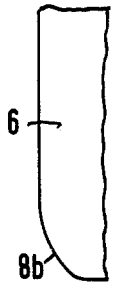
Figure 4C:
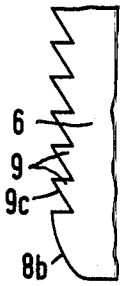
Figure 4D:
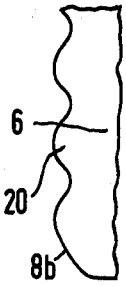

FIGS. 4*a*, 4*b*, 4*c* and 4*d* illustrate various configuration which the chip blank ends can take. FIG. 4*a* shows the simplest construction in which the leading edge of the ends 6 simply have an angular bevel 8. It is essential that the bevel cover an area of no more than half the length of the lateral blank ends. Otherwise, if the wire clamped between the clip 2 and the connector pin 1 is stressed in tension, the clip can possibly tip about point 19 and bring about an unstable seating of the clip on the connector pin. FIG. 4*b* illustrates a second embodiment in which the leading edge has a runnerlike shape 8*b* essentially as described in connection with FIGS. 1 and 2. The difference here is that the triangular teeth are not formed in this embodiment. The bevel 8*b* prevents chip formation to an even greater degree than the bevel 8 of FIG. 4*a* since the clip glides over the tin coating 14 to protect the material even better. These first two embodiments permit application without chip removal but requiring less force than in the prior art.

As was described above, further advantages are obtained by making the surface of the edge 6 which contacts the connector pin in the form of triangles or corrugations. This results in increased pull-off strengths and the establishment of optimum point contact. FIG. 4*c* illustrates an embodiment quite similar to what is shown on FIG. 2. Here, the leading edge 8*b* is still in the form of a runner. However, the triangular cutouts 9 now have leading edges 9*c* which are simply beveled rather than in the shape of a runner as in FIG. 2. The inclination of the leading edges 9*c* relative to the vertical is optimized so that no chip formation occurs due to too great an inclination but so that the number of triangular cutouts is not reduced, through too small an inclination to the point were sufficient electrical and mechanical contact is not obtained because of the small number of contact points 10. Although this embodiment is good, the embodiment shown by FIG. 2 in which the leading edges have a runner shape is considered superior. With regard to the embodiment of FIGS. 2 and 3, it should be noted that the radii of curvature of the leading edges 9*b* are smaller than the radius of curvature of the runner 8*b*. This permits sliding on without chip removal and also achieves a great number of contact points 10. i.e., The same basic considerations are involved here as in the case of the bevel slopes of the embodiment of FIG. 4*c*.

Finally, FIG. 4*d* illustrates waves 20 rather than triangular teeth 9. With these waves or corrugations 20 point contact or point seating still occurs and the formation of chips is also avoided. However this embodiment permits ease in pulling the clip off the connector pin 1 because there are no barbs which dig into it.

In summary the clip of the present invention permits a standarization of a connector pin which can be used both for the type of Termi point connections described above and solder connections. This is accomplished because the restrictions on the thickness of tin coating 14 of the connector pin 1 to 4 $\mu$m $\pm$ 2 $\mu$m is no longer necessary with the clip of the present invention. In addition, the clip of the present invention permits the establishment of better electrical contacts meeting higher electrical and mechanical requirements with respect to the quality of electrical contact and the pull-off strength. Although specific embodiments have been illustrated and described, it will be obvious to those skilled in the art that various modifications may be made without departing from the spirit of the invention which is intended to be limited solely by the appended claims.

What is claimed is:

1. A metal clip for making an electrically conducting connection of a bare wire to a connector pin, the clip being of the type which encompasses the wire and the connector pin in a sleevelike manner and comprises a piece of sheet metal bent in a U-section with the free legs of the U-section bent at their ends in a U-shape so that the edges of the legs contact one side of the connector pin, wherein the improvement comprises:

the sheet metal ends of both legs which point toward the clip interior and contact said side of the connector pin having on their leading edge a bevel starting at said leading edge and extending over a portion of their length, said ends also being corrugated over at least a portion of their length adjacent said bevel.

2. A clip according to claim 1 wherein said bevel is in the shape of a runner.

3. A clip according to claim 1 wherein said corrugations are in the form of a sequence of triangular cutouts extending over at least a portion of the length of said ends.

4. A clip according to claim 2 wherein said corrugations are in the form of a sequence of triangular cutouts extending over at least a portion of the length of said ends.

5. A clip according to claim 4 wherein the leading edge of at least the first one of said sequence of triangular cutouts has the shape of a runner.

* * * * *